US007100412B2

(12) United States Patent
Derichs

(10) Patent No.: US 7,100,412 B2
(45) Date of Patent: Sep. 5, 2006

(54) HARD-ROLLING ROLLER HEAD PERTAINING TO A HARD-ROLLING TOOL

(75) Inventor: Heinrich Wilhelm Derichs, Wegberg (DE)

(73) Assignee: Hegenscheidt-Mfd GmbH & Co. KG, Erkelenz (DE)

( * ) Notice: Subject to any disclaimer, the term of this patent is extended or adjusted under 35 U.S.C. 154(b) by 0 days.

(21) Appl. No.: 10/504,107

(22) PCT Filed: Apr. 25, 2003

(86) PCT No.: PCT/EP03/04305

§ 371 (c)(1),
(2), (4) Date: Aug. 10, 2004

(87) PCT Pub. No.: WO03/090972

PCT Pub. Date: Nov. 6, 2003

(65) Prior Publication Data

US 2005/0066700 A1 Mar. 31, 2005

(30) Foreign Application Priority Data

Apr. 26, 2002 (DE) ..... 102 18 703

(51) Int. Cl.
*B21D 15/00* (2006.01)
*B21K 1/08* (2006.01)

(52) U.S. Cl. ..... 72/110; 29/6.01

(58) Field of Classification Search ..... 72/107, 72/110; 29/6.01

See application file for complete search history.

(56) References Cited

U.S. PATENT DOCUMENTS 5,575,167 A 11/1996 Gottschalk et al.
5,699,692 A 12/1997 Lonero et al.
6,253,590 B1 * 7/2001 Lonero et al. ..... 72/110
6,257,037 B1 * 7/2001 Lonero et al. ..... 72/110
6,360,574 B1 * 3/2002 Vodopyanov ..... 72/110
6,389,861 B1 * 5/2002 Bagusche et al. ..... 72/110
6,393,886 B1 * 5/2002 Bagusche ..... 72/110
6,601,424 B1 * 8/2003 Bagusche ..... 72/110
2002/0020202 A1 2/2002 Bagusche

FOREIGN PATENT DOCUMENTS

DE 10 05 869 4/1957
EP 0 661 137 7/1995
EP 0 839 607 5/1998

* cited by examiner

*Primary Examiner*—Ed Tolan
(74) *Attorney, Agent, or Firm*—Proskauer Rose LLP

(57) ABSTRACT

The invention relates to a deep-rolling roller head (1) of a deep-rolling tool for the deep rolling of radii or undercuts (22) on the main and stroke journals of crankshafts (21), with a housing (2) in which one or two deep-rolling rollers are tracked with little clearance and are loosely rotatable in a roller cage (5) at a lateral distance from each other. The roller cage (5) is attached to underside (3) of the housing (2) towards the crankshaft (21) by means of pins (15) which support the roller cage (5) on its face (10) away from the deep-rolling rollers (4) and at the same time track them laterally. The housing (2) is provided with a projection (11, 12) for the support of the roller cage (5) on either end of its underside (3) towards the crankshaft (21). Pins (15) serving as fastening and tracking elements of the roller cage (5) are provided and engage the roller cage (5).

3 Claims, 3 Drawing Sheets

-3-
-21-
II
II
1
2
3
4
5
7
11
12
13
14
15
16
20
22
23
25

HARD-ROLLING ROLLER HEAD PERTAINING TO A HARD-ROLLING TOOL

RELATED APPLICATIONS

This application was filed in accordance with 35 U.S.C. §371 and is the U.S. National stage of International Application No. PCT/EP03/04305, filed on Apr. 25, 2003. This application claims priority under 35 U.S.C. §119(a) or 35 U.S.C. §365(b) to German application number 102 18 703.7-14, filed on Apr. 26, 2002. The disclosures of the above-referenced applications are hereby incorporated by reference in their entirety.

The present invention relates to a deep-rolling roller head of a deep rolling tool as in the introductory clause of the main claim.

BACKGROUND OF THE INVENTION

Deep-rolling roller heads of this type are known e.g. from the following published documents:

1. EP 0 661 137 B1, FIG. 6,
2. EP 0 683 012 B1, FIG. 4,
3. EP 0 839 607 A1, FIG. 1
4. U.S. Pat. No. 5,575,167 FIG. 7 and
5. U.S. Pat. No. 5,806,184 FIG. 2a.

A deep-rolling roller head of this type is however also the object of an older German patent application DE 102 18 703.7 of Jul. 26, 2002 by the same applicant.

The known deep-rolling roller heads have in common that the roller cages are attached on the respective housings of the deep-rolling roller head by means of L-shaped holding devices. The roller cages can be brought into a predetermined position by means of the holding devices and can be fixed on the deep-rolling roller head. For this purpose the deep-rolling rollers are tracked loosely in a rotatable manner in their respective roller cages with little lateral clearance. This clearance amounts as a rule to approximately 0.2 mm. In addition, the deep-rolling rollers are to be offset by approximately 0.2 mm in the direction of the crankshaft relative to the center of the housing of the deep-rolling roller head around which a guide roller of the deep-rolling rollers on which the deep-rolling rollers are supported relative to the crankshaft rotates. In addition the deep-rolling rollers in the deep-rolling roller head also have a spread in the axial direction of a crankshaft.

The precise, i.e. predetermined position of the deep-rolling rollers in the deep-rolling roller head is determining for its serviceable life. Wear occurs in spite of precise adjustment and increases the clearance between the deep-rolling rollers and the roller cages in the course of the deep-rolling roller tool's utilization. From this it can be seen that the precise adjustment of the deep-rolling rollers in the deep-rolling roller head is of particular importance. The adjustment and also the resetting that follows when wear has occurred are performed in the deep-rolling roller heads known from the state of the art via the L-shaped holding devices of the roller cages. Under the best possible circumstances, setting gauges are available for this adjustment. It is also customary to have a person schooled in the art perform the adjustment manually. In that case it has been noted that the serviceable life of the deep-rolling rollers and of the roller cages are influenced substantially by the skill of the person schooled in the art making the adjustment. The adjusting of the deep-rolling rollers is furthermore a slow job, requiring much work time.

This leads to the object of the present invention, to improve a deep-rolling roller head in such manner, and in particular to simplify the configuration of the roller cage to such an extent that precise adjustment of the deep-rolling rollers becomes possible without any special skill or any great expenditure in work time. It should also be possible to equalize wear. At the same time the life of the deep-rolling rollers and of the roller cages as well as the quality of the deep-rolled product are to be improved. Finally the improvement should be easy and economical and also personnel with lesser practice should be able to realize it.

SUMMARY OF THE INVENTION

The object is attained through a novel configuration of the housing and of the deep-rolling roller head, producing thereby at the same time a novel configuration of the roller cage in accordance with the characteristics of the main claim.

From now on the known L-shaped holding devices of the roller cages and their elaborate adjustment on the housing of the deep-rolling roller head are no longer used, so that considerable simplification is achieved. By pulling down the two outer ends of the face of the housing of the deep-rolling roller head facing the crankshaft, stops are obtained in a simple manner to support the outer faces of the roller cage. Hereby modern manufacturing methods are put to use making it possible to create a precisely fitting opening between the two projections of the face of the housing. The roller cage, produced with great precision, is then set into this opening, whereby the required clearance of 0.2 mm between the roller cage and the deep-rolling rollers is already provided. The modern manufacturing methods as well as the configuration of the roller cage make it furthermore possible to establish the lateral offset of the rotational axes of the deep-rolling rollers relative to the center of rotation of the housing of the deep-rolling roller head. The opening on the underside of the housing of the deep-rolling roller head is simply shifted by the amount of the offset of approximately 0.2 mm in the direction of rotation of the crankshaft relative to the center of the housing.

As wear occurs, the roller cage is simply turned around so that now the less worn guiding grooves of the one-piece roller cage are being used.

Thanks to the new configurations, a single one-piece roller cage is now provided for one or two deep-rolling rollers, depending on the application, instead of two roller cages, as was normal until now. One-piece means that the two deep-rolling roller cages of the conventional type that were separated from each other are now combined into one single production piece that only needs to be pushed into the opening between the projections on the underside of the housing of the deep-rolling roller head together with the one or the two deep-rolling rollers and be attached. At the same time the roller cage retains as before a longitudinal groove on its underside towards the crankshaft via which it is held and tracked laterally on the housing by a suitable element.

According to the invention the element comprises a simple, flat bracket whose two ends are screwed to the two ends at the projections of the housing and whose free center engages a groove on the underside of the roller cage. Instead of a bracket, two pins can however be provided, each of which is provided in one of the projections on the underside of the housing. These pins can both be displaced in the direction of their longitudinal axis and each engages a corresponding opening on the outer face of the roller cage and is screwed in a detachable manner to the projections.

These simple means obviate from now on the time-consuming and not reliably precise adjusting of roller cages by means of the known L-shaped holders on the housing of the deep-rolling roller head.

BRIEF DESCRIPTION OF THE DRAWINGS

The invention is explained below through two examples of embodiments.

Drawn to scale,

The deep-rolling roller head 1 has a nearly rectangular flat housing 2. The underside 3 of the housing 2 is facing the crankshaft 21 of which FIG. 1 shows the section through a random main bearing, whose journals are each delimited laterally in the axial direction of the crankshaft by radii or undercuts 22. The deep-rolling rollers 4 which are in turn supported so as to be loosely rotatable in one of the roller cages 5 or 6 FIG. 4 or 8 engage these radii or undercuts 22. When the deep-rolling roller tool is new, the clearance between the deep-rolling rollers 4 and the corresponding roller cages 5 or 6 is approximately 0.1 to 0.5 mm, preferably 0.2 mm. The face 8 of an inner opening 17 of the two roller cages 5 and 6 are at a lateral distance of each other and also at a lateral distance from the point of rotation 7 of the housing 2; the latter measures approximately 0.2 mm.

DETAILED DESCRIPTION OF THE INVENTION

Figures 4, 5, 6, 7:
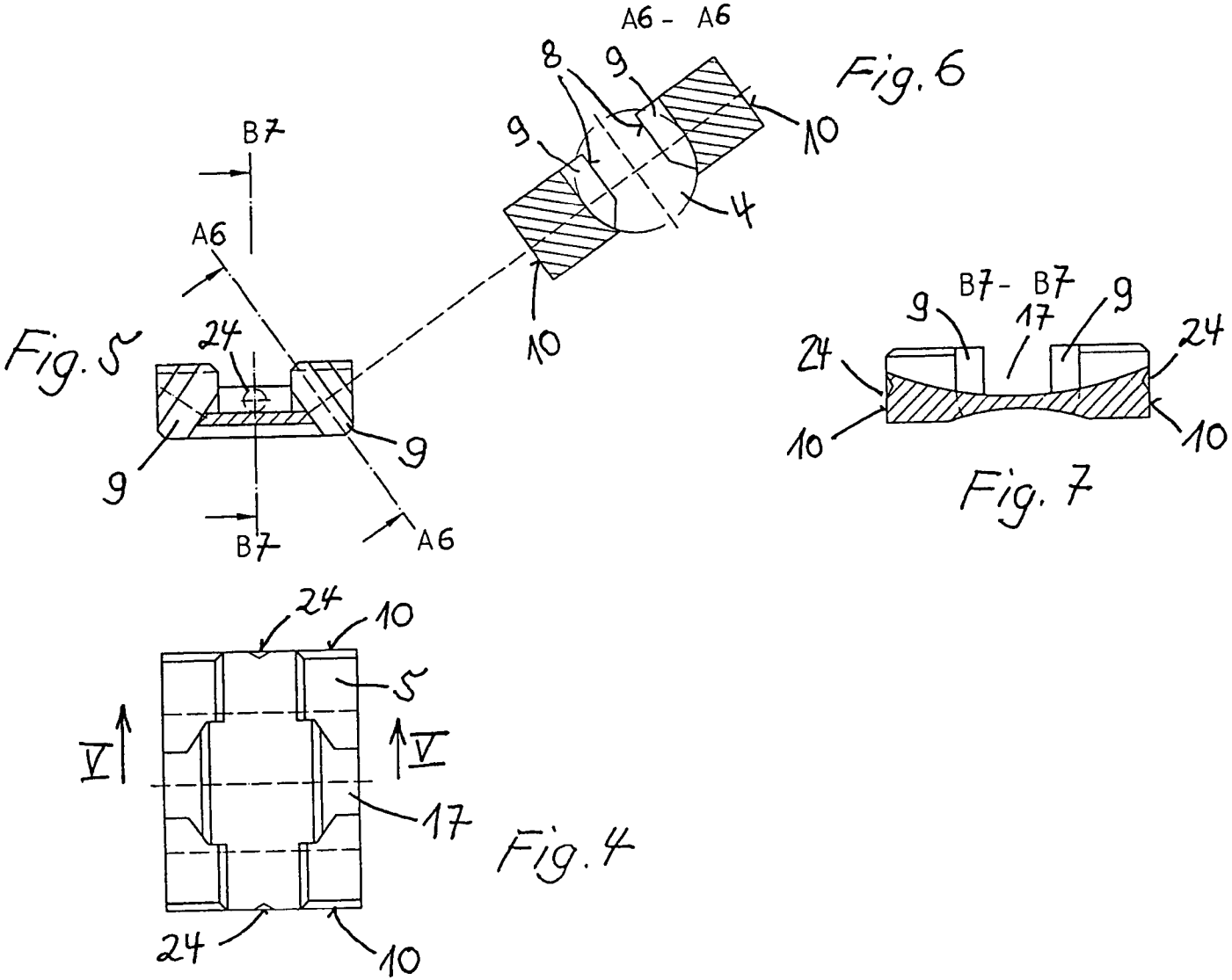
FIG. 4 shows a top view of a first embodiment of a roller cage.
FIG. 5 shows a cross-section along line V—V.
FIG. 6 shows a section along line A6—A6.
FIG. 7 shows a section along line B7—B7.
Figures 8, 9, 10, 11:
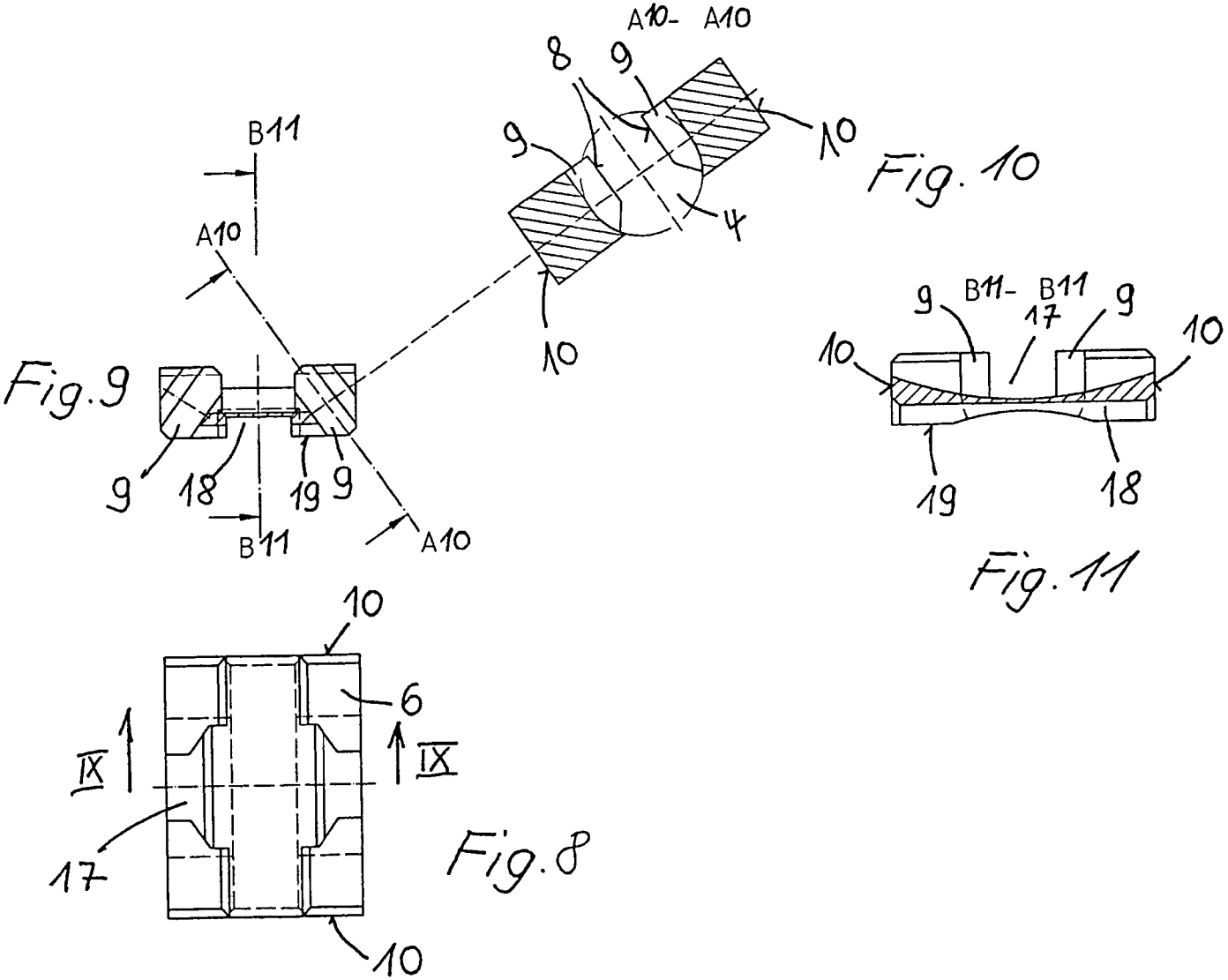
FIG. 8 shows a top view of a second embodiment of a roller cage.
FIG. 9 shows a cross-section along line IX—IX.
FIG. 10 shows a section along line A10—A10 and FIG. 11 shows a section along line B11—B11.

On their faces 8 across from each other of the inner opening 17 each of the roller cages 5 and 6 is provided with groove-shaped openings 9 in which a deep-rolling roller 4 is rotatably held on two sides across from each other on the circumference of its body. The FIGS. 5 and 9 show the two openings 9 on the faces 8 of one of the roller cages 5 or 6. The inclined position of the openings 9 that can be seen in FIGS. 5 and 9 corresponds at the same time to the inclined position of the deep-rolling rollers 4 in the deep-rolling roller head 1.

On its outer faces 10 across from the inner faces 8 the roller cages 5 and 6 are supported on corresponding projections 11 and 12. The projections 11 and 12 project on the underside 3 of the housing 2 and leave an opening 13 between them in which the corresponding roller cages 5 and 6 are seated with their deep-rolling rollers 4. The roller cages 5 and 6 are not connected to the housing 2 or to its projections 11 and 12. They are supported and move with little clearance in the opening 13 between the two projections 11 and 12 so that they can be pushed into the opening 13 from the underside 3. The roller cages 5 and 6 bear in this case with their rear faces 10 respectively on corresponding surfaces 14 of the projections 11 and 12.

To hold the roller cage 6 on the housing 2 for example, a bracket (not shown) is provided. The bracket consists of a flat piece of iron of little length and width and is connected detachably by screws (not shown) to the corresponding projections 11 and 12 of the housing 2. The bracket engages a groove 18 with its free center, said groove being made on the underside 10 of the roller cage 6 (FIGS. 9 and 11).

Figures 1, 2, 3:
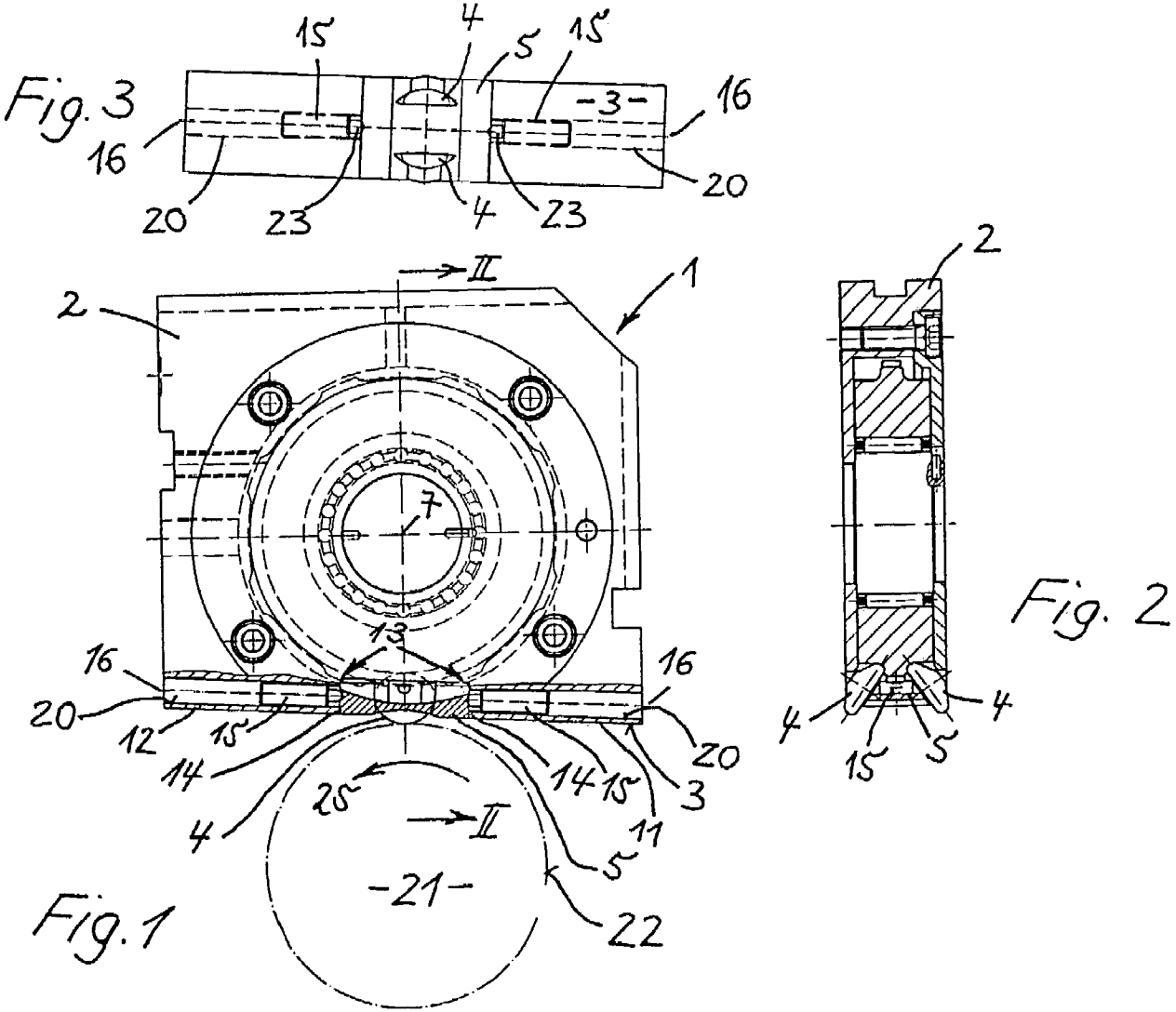
FIG. 1 shows a deep-rolling roller head in a side view.
FIG. 2 shows a section along line II—II of FIG. 1.
FIG. 3 is a view of the underside of the deep-rolling roller head of FIG. 1.

Instead of a bracket it is also possible to provide pins 15 that hold and track e.g. the roller cage 5 on the projections 11 and 12 of the housing 2. The pins 15 are inserted into threaded bores 20 along their common longitudinal axis 16, can be displaced in longitudinal direction and can be immobilized. These threaded bores are located along the longitudinal center of the underside 3 of the housing 2 (FIG. 3). On their inner ends, i.e. the ends towards the deep-rolling roller cage 5, the pins 15 are provided with small pins 23 with which they engage an opening 24 on the outer face 10 of the deep-rolling roller cage 5, as can clearly be seen in FIG. 1.

During deep-rolling of the undercuts 22, the crankshaft 21 is caused to rotate by the spindle drive of the deep-rolling machine (not shown) and rotates away in the direction of arrow 25 below the deep-rolling roller head 1.

REFERENCE NUMBER LIST

1 deep-rolling roller head 1
2 housing
3 underside
4 deep-rolling roller
5 roller cage
6 roller cage
7 center of rotation
8 face
9 opening
10 face
11 projection
12 projection
13 openings
14 bearing surface
15 pin
16 longitudinal axis
17 inner openings
18 groove
19 underside
20 threaded bore
21 crankshaft
22 undercut
23 journal
24 depression
25 direction of rotation.

The invention claimed is:

1. Deep-rolling roller head of a deep-rolling tool for deep rolling of radii or undercuts on the main and pin bearing journals of crankshafts, with a housing in which one or two deep-rolling rollers are moving loosely and rotatably with little clearance in roller cages at a lateral distance from each other in function of an axial width of the associated bearing journal, whereby the roller cages are attached to an underside of the housing towards the crankshaft by means of holding devices that support the roller cages on their faces away from the deep-rolling rollers and at the same time track them laterally, whereby the housing is provided with a projection for the support of the roller cages on its underside towards the crankshaft, with a projection for the support of the roller cages being provided on either end of the underside and attachment and guiding elements are provided for the roller cages and engage each roller cage and can be attached to the projections of the housing, wherein a roller cage for deep-rolling rollers is provided in the opening between the two projections on the underside of the housing of the deep-rolling roller head, this roller cage being made in one piece, with each of its two outer faces being supported on a bearing surface by one of the two projections, with at least one deep-rolling roller moving loosely and rotatably between faces of an inner groove-shaped opening of the roller cage, and being connected via an attaching element to the housing of the deep-rolling roller head.

2. Deep-rolling roller head as in claim 1, wherein the attachment element is in form of a bracket that engages a longitudinal groove of the roller cage that is provided on its underside towards the crankshaft.

3. Deep-rolling roller head as, in claim 1, wherein the attachment element is made in form of a pin that is movable and adjustable in its corresponding projection on the underside of the housing and engages a depression of the roller cage.

* * * * *